US007010943B1

(12) United States Patent
Earl

(10) Patent No.: US 7,010,943 B1
(45) Date of Patent: Mar. 14, 2006

(54) FOLDABLE GRIP FOR HANDCUFF PAIR AND COMBINATION THEREOF

(76) Inventor: Alan Lewis Earl, 17029 Lane's End La., Dixon, MO (US) 65459

( * ) Notice: Subject to any disclaimer, the term of this patent is extended or adjusted under 35 U.S.C. 154(b) by 0 days.

(21) Appl. No.: 11/053,643

(22) Filed: Feb. 8, 2005

Related U.S. Application Data

(60) Provisional application No. 60/547,412, filed on Feb. 24, 2004.

(51) Int. Cl.
*E05B 75/00* (2006.01)

(52) U.S. Cl. ..... 70/16

(58) Field of Classification Search ..... 70/15–17
See application file for complete search history.

(56) References Cited

U.S. PATENT DOCUMENTS

| | | | | |
|---|---|---|---|---|
| 3,740,977 A | | 6/1973 | Stefansen et al. | |
| 4,840,048 A | | 6/1989 | Elam | |
| 5,007,257 A | | 4/1991 | Thompson | |
| 5,233,848 A | | 8/1993 | Elam | |
| 5,526,658 A | | 6/1996 | Cross et al. | |
| D373,446 S | | 9/1996 | Kim | |
| 5,613,381 A | | 3/1997 | Savage | |
| 5,687,593 A | * | 11/1997 | Cross | 70/16 |
| 5,732,576 A | * | 3/1998 | Moore et al. | 70/16 |
| 6,269,939 B1 | * | 8/2001 | Lapeyre et al. | 198/615 |
| 2004/0216501 A1 | | 11/2004 | Clifton, Jr. | |

OTHER PUBLICATIONS

Well known by law enforcement professionals and known to the inventor.

* cited by examiner

*Primary Examiner*—Suzanne Dino Barrett
(74) *Attorney, Agent, or Firm*—Richard L. Marsh

(57) ABSTRACT

A grip for a handcuff pair comprises a pair of opposed bodies each comprising a pair of wristlet lock capturing members which capture the wristlet lock portions of the handcuff pair therebetween. At least one of the pair of wristlet lock capturing members is joined together by a hinge disposed between the wristlet lock portions of the handcuff pair and is substantially located over a bendable joint of a link member joining the wristlet lock portions together into the handcuff pair.

14 Claims, 3 Drawing Sheets

FOLDABLE GRIP FOR HANDCUFF PAIR AND COMBINATION THEREOF

CROSS REFERENCE TO RELATED APPLICATIONS

This application is a non-provisional application claiming priority benefit of provisional application 60/547,412 filed on 24 Feb. 2004 by the inventor hereof.

BACKGROUND OF THE INVENTION

1. Field of the Invention

This invention relates to a grip for handcuffs which is foldable with the handcuffs and opens upon withdrawal from the handcuff holster.

2. Prior Art Statement

Current standard handcuffs are difficult to grip for people with small or very large hands. Furthermore, people with smaller hands have difficulty controlling both handcuffs while keeping tension on the chain between cuffs when applying the handcuffs. Larger hands have a tendency to cover the opening for the single bar of the handcuff preventing proper closure of the handcuff. Also, the narrow chain members are hard to grasp and the metal surface of the standard handcuff does not provide a proper gripping surface. In addition to these limitations due to the physical features of the handcuffs, difficulties caused by environmental and physiological factors need to be overcome. For instance, when attempting to handcuff in cold weather, fine motor skills are reduced as the fingers do not grip as tightly as in a normal environment. Handcuffing in warm weather or during stress is also difficult as the hand sweats making the metal handcuff slippery. Finally, when attempting to handcuff, the officer must withdraw the cuffs from a carrier, orient the cuff in the proper attitude and then apply the cuff. Sometimes, the officer must look at the cuff to determine the proper attitude thus diverting attention from the suspect which results in danger to the officer.

It is known to provide a rigid bar with closeable manacle clasps at the ends thereof. For instance, see the U.S. Pat. No. 5,613,381 issued on 25 Mar., 1977 to Julie M. Savage or the U.S. Pat. No. 5,223,848 issued on 10 Aug. 1993 to Dennis Elam or the U.S. Design Patent Des. 373,446 issued on 3 Sep. 1996 to Kim, et al. Elam and Kim, et al., additionally show an ergonomically shaped rigid bar, however, in all three patents, the rigid bar is bulky, difficult to operate and cannot be holstered in a conventional holster generally used for handcuffs. Thus, there is a need for a grip for foldable handcuff pairs with the grip disposed over the wristlet lock portion of the handcuffs, the grip enclosing the linking chain therewithin wherein the grip is foldable with the handcuff pair.

It is also known to provide a cover assembly for handcuffs which is placed over the wristlet lock portion of the handcuff pair after the suspect has been handcuffed, the cover assembly comprising a body releasably mounted on the wristlet lock portions, the body having a separate U-shaped closure. For instance, see the U.S. Pat. No. 3,740,977 issued on 26 Jun. 1973 to Stefansen, et al. Another cover assembly for double lock handcuffs is shown in U.S. Pat. No. 5,007,257, issued to Charles E. Thompson on 16 Apr. 1991. In either patent, the cover assembly must be stored separately from the handcuff pair and installed after handcuffing the suspect thus requiring additional effort to first place and then retain the handcuffs in a rigid position. Therefore, there is still a need for a grip for foldable handcuff pairs which may be holstered with the handcuff pair.

It is further known to join together an existing handcuff pair by affixing side plates to the wristlet lock portions of the bracelet members of the handcuff pair to provide a rigid, non-moving interconnection between the handcuff bracelet members. The side plates have an ergonomic shape for ease of grasping. For instance, see U.S. Pat. No. 4,840,048 issued on 20 Jun. 1989 to Dennis Elam. Since the handcuff pair is rendered rigid, it cannot fold for storage in a conventional handcuff holster thus the handcuff pair protrudes from the belt of the officer which may cause the rigid handcuff pair to be lost. A special holster must be made for this rigid structure which is too bulky for most officers' uniforms. Accordingly, a foldable handcuff pair which retains the features of a rigid interconnection between the bracelet members yet is fully foldable with the handcuff pair is sorely needed.

Additionally, it is known to provide an ergonomic gripping member which fits over rigid plates affixed to the bracelet members of handcuff pairs. For instance, see the U.S. Patent Publication 2004/0216501 A1 published on 4 Nov. 2004 by Norman Clifton, Jr. The rigid bar has the same limitations as previously cited references but does provide an effective ergonomic grip. There still is a need for a handcuff pair which retains the features of a rigid interconnection between the bracelet members yet is foldable for storage in a conventional handcuff holster.

Finally, it is known to provide a pair of molded handgrip members which render rigid the joint between bracelet members wherein the bracelet members are joined by parallel link bars. The molded handgrip members have protrusions for interdigitating with the spaces between the link bars. For instance, see the U.S. Pat. No. 5,526,658 issued on 18 Jun. 1996 to Cross, et al. Still, the handcuff pair is a rigid structure that must be stored in the rigid form which requires a specially designed holster or the handcuff pair must be stored separately from the molded handgrip members thus necessitating additional steps in the process of handcuffing a suspect. Furthermore, with the handcuff pair protruding a substantial distance upwardly from the officer's belt, the handcuff pair may be in the way of other officer functions. It is abundantly clear that a handcuff pair which has an ergonomic grip that is foldable with the handcuff pair and storable in a conventional handcuff holster is needed.

SUMMARY OF THE INVENTION

It is an object of this invention to solve the problem of providing a handcuff pair which is joined together for ease of use and which is foldable for storage in a conventional handcuff holster.

Another object of this invention is to provide a handcuff grip that provides sufficient distance between the wristlet lock portions to ensure that the openable clasp bar can be engaged in the lock when the handcuff pair is being used by an officer having large hands yet providing a grip small enough to be gripped by an officer having smaller hands.

One aim of this invention is to provide a handcuff grip which orients the openable clasp bar outwardly and thus toward the suspect's wrists by providing finger grips on the edge of the grip adjacent the openable clasp bar of the handcuff pair.

Still another object of this invention is to provide a handcuff grip that has a textured surface on at least one side thereof to increase gripping in all environments.

A principal aim of this invention is to provide a handcuff grip for a handcuff pair that comprises a pair of opposed bodies, each body comprising a pair of wristlet lock capturing members joined by a hinge selected from the group comprising a living hinge, an elastic hinge member and a mechanical hinge or combination thereof. The wristlet lock capturing members capture wristlet lock portions of the handcuff pair therebetween with the hinge disposed between the wristlet lock portions and substantially located over a bendable joint of a link member joining the wristlet lock portions together into the handcuff pair.

A purpose of this invention it to provide a handcuff grip for a handcuff pair that comprises a pair of opposed bodies, each body comprising a pair of wristlet lock capturing members having a lock capturing recess disposed into an inside surface at the ends thereof wherein the wristlet lock capturing members are fastened into the wristlet lock capturing recess of the wristlet lock portions of the handcuff pair by means for fastening selected from the group comprising bolts, screws, adhesives, bayonet posts and sockets, rivets or push through fasteners.

Another aim of this invention it to provide a handcuff grip for a handcuff pair that comprises a pair of opposed bodies, each body further comprising a pair of wristlet lock capturing members disposed inwardly from the ends thereof wherein the wristlet lock capturing members of one pair of opposed bodies are fastened to the wristlet lock capturing members of the other of the opposed bodies by means for fastening selected from the group comprising bolts, screws, adhesives, bayonet posts and sockets, rivets or push through fasteners and wherein the wristlet lock capturing members capture wristlet lock portions of the handcuff pair therebetween. A link member retains the wristlet lock portions of the handcuff pair in the lock capturing recess.

Still another goal of this invention it to provide a handcuff grip for a handcuff pair that comprises a pair of opposed bodies which have a slot disposed through a portion thereof for accommodating a link member of a handcuff pair therein allowing for bending of the link member. The opposed bodies also have finger contours disposed inwardly from one side edge thereof to facilitate orientation of the handcuff pair in the proper attitude wherein an openable clasp bar of the handcuff pair is disposed adjacent the side edge carrying the finger contours. Additionally, the opposed bodies preferably have a palm contour disposed inwardly from a side edge opposite the finger contours to further assist in orienting the handcuff pair in the proper attitude and for gripping the handcuff pair. The handcuff grips have a textured surface on at least one of the wristlet capturing members of the opposed bodies to enhance frictional contact of a human hand with the grip wherein the textured surface is selected from the group comprising raised knobs, raised ridges separated by grooves, abrasive material, depressed dimples or a combination thereof A general purpose of this invention is to provide a handcuff grip having wristlet lock capturing members formed from material selected from the group comprising wood, metal, thermoplastic, rubber, ivory, or combinations thereof and wherein a hinge is integrally formed between the pair of wristlet lock capturing members of the same material as the wristlet lock capturing members.

Yet another goal of this invention is to provide a combination of a handcuff grip and a handcuff pair, wherein the handcuff grip comprises a pair of opposed bodies having wristlet lock capturing members at the opposed ends thereof, the wristlet lock capturing members joined by an elastic living hinge. The opposed bodies are affixed to wristlet lock portions of the handcuff pair with the elastic living hinge disposed between the wristlet lock portions and substantially located over a bendable joint of a link member joining the wristlet lock portions together. The elastic living hinge between the wristlet lock capturing members facilitates opening of the handcuff pair by resuming an at rest position of the elastic living hinge wherein the elastic living hinge on an inner pair of the wristlet lock capturing members pushes the inner pair of the wristlet lock capturing members apart and the elastic living hinge on an outer pair of the wristlet lock capturing members pulls the outer pair of wristlet lock capturing members together.

Finally, it is an object of this invention to provide foldable manacles having a centrally disposed grip foldable with the manacles wherein the manacles comprise a pair of closeable wrist cuffs wrist cuffs extending from one edge of separate wristlet lock portions with the wristlet lock portions joined together by at least two links of a link member. The grip comprises a pair of opposed bodies, each body comprising a pair of wristlet lock capturing members, at least one of the pair of wristlet lock capturing members joined by an elastic living hinge, the opposed bodies affixed to the wristlet lock portions of the handcuff pair and having an elastic living hinge disposed between the wristlet lock portions of the handcuff pair and substantially located over one bendable joint of a link member joining the wristlet lock portions.

DESCRIPTION OF THE PREFERRED EMBODIMENTS

While the various features of this invention are hereinafter described and illustrated as a grip for handcuffs which folds with the handcuffs and opens upon withdrawal from the handcuff holster, it is to be understood that the various features of this invention can be used singly or in various combinations thereof for a manacle grip for making a rigid connection between bracelet members of a handcuff pair as can hereinafter be appreciated from a reading of the following description.

Figure 1:
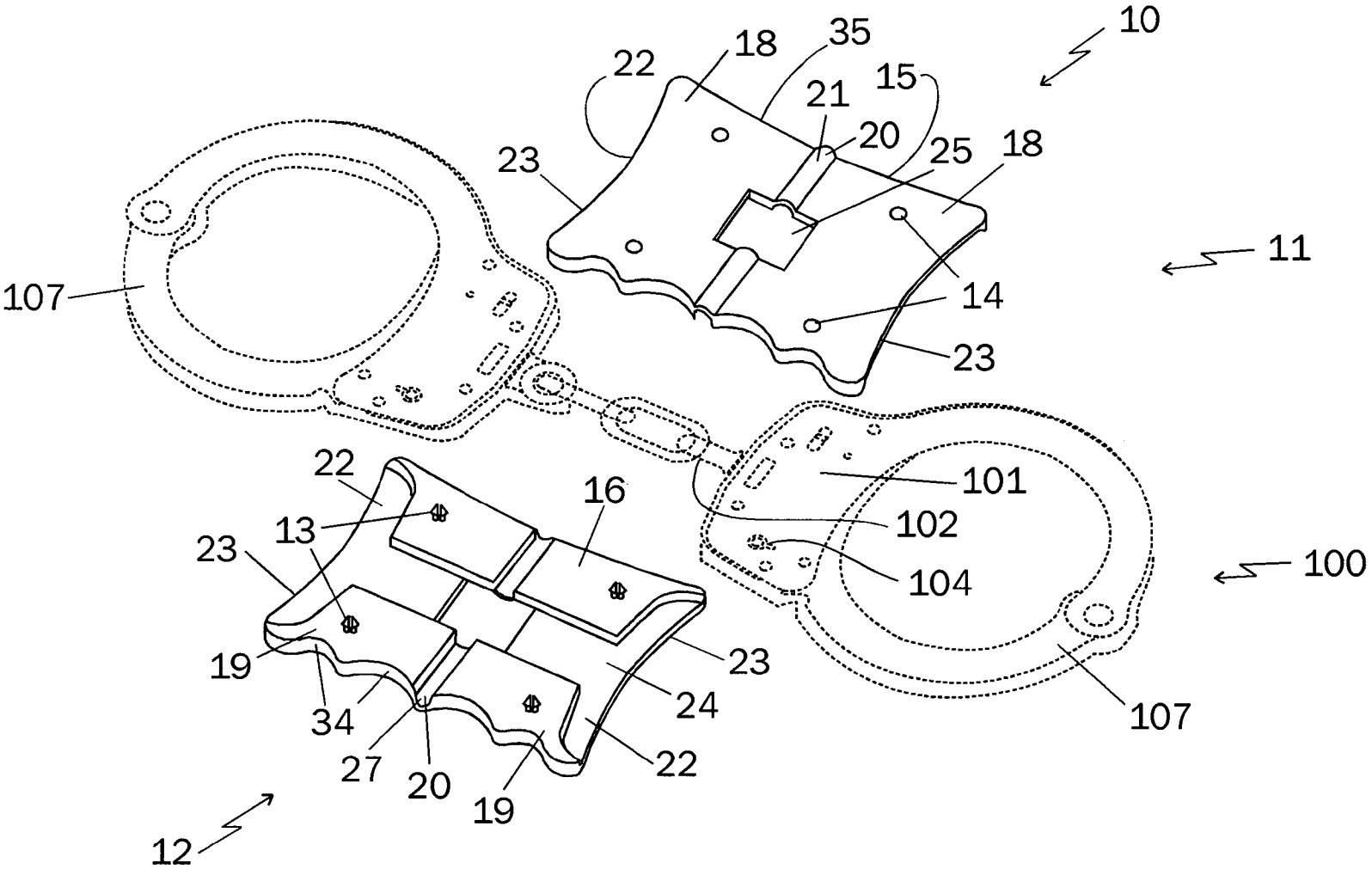
FIG. 1 is an exploded perspective view of the preferred embodiment of the manacle or handcuff grip of this invention with a handcuff pair shown in phantom between the upper and lower body of the grip.

Referring now to FIG. 1, a handcuff grip generally shown by the numeral 10 comprises an upper body 11 and a lower body 12. Upper body 11 and lower body 12 are substantial mirror images from a central plane therebetween, however, lower body 12 preferably carries a plurality of bayonet posts 13 extending therefrom, bayonet posts 13 adapted to engage anchoring holes 14 disposed through upper body 11. It should be fully understood here, that though the preferred embodiment of this invention is shown in the drawings and described in the instant specification, handcuff grip 10 of this invention may alternately comprise other means of fastening upper body 11 and lower body 12 together about a handcuff pair 100, shown in FIG. 1 in phantom, without departing from the scope of this invention. For instance, anchoring holes 14 may be disposed through both upper body 11 and lower body 12 wherein anchoring holes 14 receive fasteners therethrough. Furthermore, it is entirely possible within the scope of this invention to provide adhesive means on portions of the inside surfaces 15, 16 of upper body 11 and lower body 12, respectively, in order to firmly affix upper body 11 to lower body 12 about or to the wristlet lock portions 17 of a handcuff pair 100. It is also within the scope of this invention to provide the plurality of bayonet posts 13 on the inner surface of upper body 11 while disposing anchoring holes 14 through or into lower body 12.

Opposed bodies 11, 12 of handcuff grip 10 comprise a pair of wristlet lock capturing members 18, 19 wherein at least one pair of wristlet lock capturing members 18, 19 is joined by a hinge 20, hinge 20 shown as a living hinge 27 on lower body 12, however it is fully understood that hinge 20 may alternately be an elastic or mechanical hinge. For instance, in FIG. 2, an elastic member 21 is shown spanning across the top of the closed pair of bodies 11, 12, elastic member 21 affixed to or integral with wristlet lock capturing members 18. Wristlet lock capturing members 18, 19 of opposed bodies 11, 12 capture wristlet lock portions 101 of handcuff pair 100 therebetween when wristlet lock capturing members 18, 19 are closed against wristlet lock portions 101. Wristlet lock capturing members 18, 19 have a recess 22 disposed into an inside surface 15, 16 respectively, recess 22 best shown in FIG. 1 disposed into inside surface 16 of wristlet lock capturing members 19 it being understood that a similar recess is disposed into the hidden inside surface 15 of wristlet lock capturing members 18. The length of recess 22 from free ends 23 of wristlet lock capturing members 18, 19 is sufficient to surround wristlet lock portions 101 from a point adjacent a link post 102 to about half the length of wristlet lock portion 101 leaving sufficient clearance for exposure of a keylock hole 104. Additionally, the depth of recess 22 from inside surface 15, 16 of wristlet lock capturing members 18, 19 is approximately half the thickness of wristlet lock portion 101 such that inside surface 15 and 16 are substantially contiguous when bodies 11 and 12 are joined into handgrip 10. Hinge 20 is disposed substantially centrally between wristlet lock portions 101 of handcuff pair 100 and located substantially directly over a bendable joint 106 of a link member 105 joining wristlet lock portions 101 together into handcuff pair 100. Preferably, a slot 24 is disposed through a portion of upper and lower bodies 11, 12 between ends 23 for accommodating link member 105 therein and a hole 25 is disposed through bodies 18, 19 from slot 24 to the outer surface thereof thus allowing for bending of link member 105 about bendable joint 106 and limited relative movement of handcuffs 107. Slot 24 may be alternately disposed in only one body 11, 12 while smaller hole 25, shown in FIG. 3, is provided through the opposed body 12, 11 thus allowing bendable joint 106 to protrude through hole 25 when handcuff 101 having handcuff grip 10 disposed thereupon is folded for storage in a handcuff holster.

Figure 4:
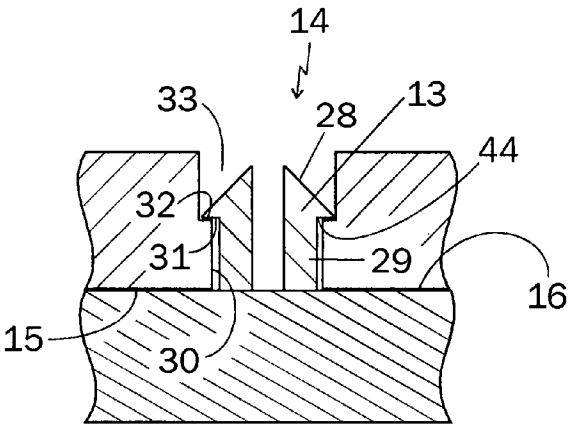
FIG. 4 is a greatly enlarged cross section of the preferred bayonet post of one wristlet lock capturing portion of the handcuff grip of this invention inserted in and captured in a hole in an opposed wristlet lock capturing portion.

Handcuff grip 10 preferably has wristlet lock capturing members 18, 19 of one pair of opposed bodies 11, 12 fastened to wristlet lock capturing members 19, 18 of the other opposed body 12, 11 by means for fastening selected from the group comprising bolts, screws, adhesives, bayonet posts and sockets, rivets or push through fasteners. By fastening together wristlet lock capturing members 18, 19, wristlet lock portions 101 are captured therebetween and link member 105 retains wristlet lock portions 101 of handcuff pair 100 in lock capturing recess 22 disposed in ends 23 of wristlet lock capturing members 18, 19 by restricting movement of handcuffs 107. In the preferred embodiment shown in the figures, bayonet posts 13 are provided on inside surface 16 of lower body 12, bayonet posts 13 adapted to be inserted into anchoring holes 14 in upper body 11. Referring now to FIG. 4, bayonet posts 13 have an enlarged head 28 at the outer end 44 thereof and have a split shank 29 extending upwardly from inside surface 16 wherein when enlarged head 28 is inserted into anchoring hole 14, enlarged head 28 will pass through anchoring hole 14 expanding upon emerging from the reduced diameter portion 30 of anchoring hole 14. When enlarged head 28 has emerged from the reduced diameter portion 30 of anchoring hole 14, enlarged head 28 has a shoulder 31 immediately therebelow which rests against a flat surface 32 of a counterbore 33 of anchoring hole 14 thereby retaining enlarged head thereagainst and thus joining wristlet lock capturing members 18, 19 together. Alternately, wristlet lock portions 101 of handcuff pair 100 may be retained in lock capturing recesses 23 of wristlet lock capturing members 18, 19 and fastened thereto by means for fastening selected from the group comprising bolts, screws, adhesives, bayonet posts and sockets, rivets or push through fasteners.

Figure 2:
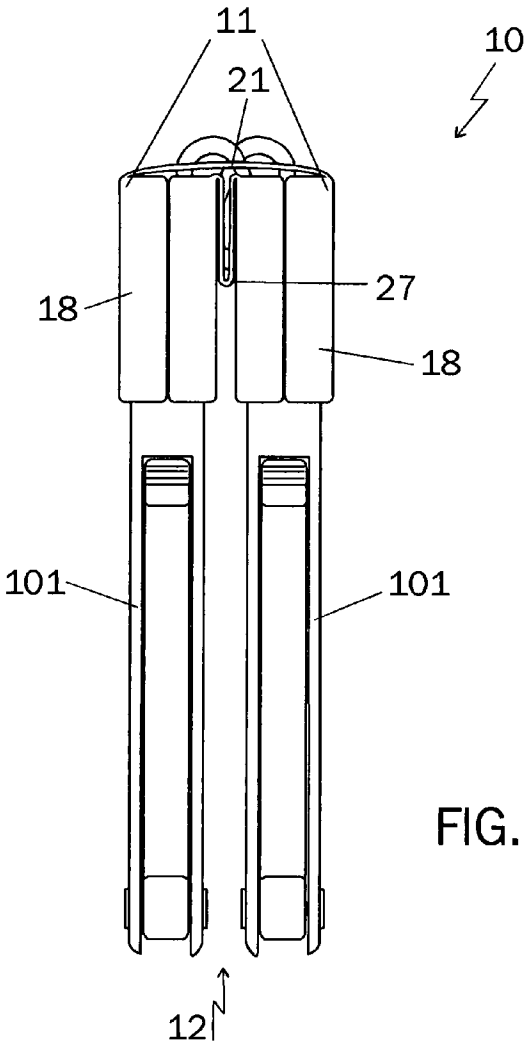
FIG. 2 is an edge view of the preferred embodiment of the handcuff grip of this invention installed upon a handcuff pair and folded for holstering in a conventional handcuff holster.
Figure 3:
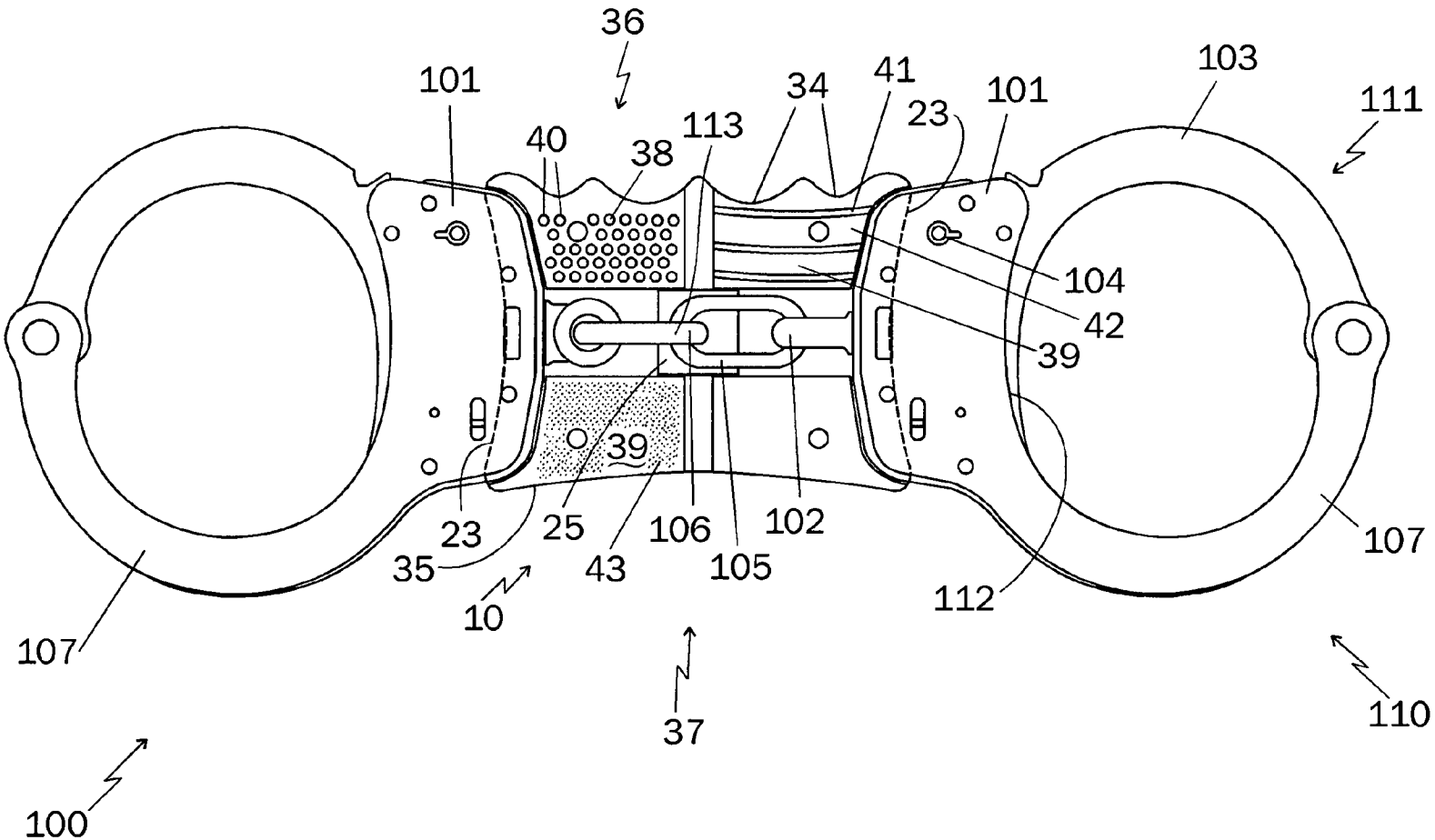
FIG. 3 is a frontal plan view of the combination of a handcuff pair employing a handcuff grip of this invention with a central portion cutaway to expose the linking chain.

As hereinbefore stated, grip 10 has wristlet lock capturing members 18 and 19 preferably each joined by hinge 20, however, one body 11, 12 may have wristlet lock capturing members 18 or 19 joined by a living hinge 27 while wristlet lock capturing members 19 or 18 of the other body 12, 11 are joined by elastic member 21 as shown in FIG. 2. Of course, wristlet lock capturing members 18, 19 may both be joined by living hinge 27 or by elastic member 21. Furthermore, wristlet lock capturing members 18 or 19 may be joined by a mechanical hinge while the opposite wristlet lock capturing members 19 or 18 is joined by elastic member 21. It is preferred that at least one hinge 20 between wristlet lock capturing members 19 or 18 have resiliency in at least one direction such that handcuff pair 100, having handcuff grip 10 installed thereupon, opens upon withdrawal from a holster holding handcuff pair 100. Where both wristlet lock capturing members 18 and 19 are joined by living hinge 27, living hinge 27 joining wristlet lock capturing members 19 will fold inwardly as shown in FIG. 2 while living hinge 27 of wristlet lock capturing members 18 will extend across the closed handcuff pair 100 in the same manner as elastic hinge 21. Likewise, where wristlet lock capturing members 19 are joined by a mechanical hinge such as a piano hinge member, not shown, and wristlet lock capturing members 18 are joined by elastic hinge 21, wristlet lock capturing members 19 will fold toward each other while elastic hinge 21 of wristlet lock capturing members 18 will extend across the closed handcuff pair 100 in the same manner as elastic hinge 21. In any of the arrangements discussed above, the elastic nature of elastic hinge 21 or elongated living hinge 27 spanning over the closed handcuff pair 100 will draw wristlet lock capturing members 18 toward a planar attitude when handcuff pair 100 carrying handcuff grip 10 therewith is withdrawn from a carrying holster. In addition, when employing living hinge 27 between wristlet lock capturing members 19, living hinge 27 will be compressed when handcuff pair 100 is holstered and will tend to return to an uncompressed state when handcuff pair 100 with handcuff grip 10 thereupon is withdrawn from the carrying holster thus assisting in opening of handcuff pair 100. As best shown in FIG. 3, when withdrawn from a carrying holster, handcuff pair 100 has handcuffs 107 extending in opposite directions and readied to be opened for handcuffing a suspect. In fact, as will hereinafter be fully explained, handcuffs 107 of handcuff pair 100 will be withdrawn from the carrying holster in an openable clasp bar attitude toward the suspect's wrists.

Handcuff grip 10 has finger contours 34 disposed inwardly from one side edge 36 thereof to facilitate orientation of handcuff pair 100 in the proper attitude wherein openable clasp bar 103 of handcuff pair 100 is disposed adjacent side edge 36 carrying finger contours 34. Finger contours 34 can easily be determined by feel when withdrawing handcuff pair 100 from the carrying holster with one hand thus providing tactile means for proper orientation. Finger contours 34 also properly orient the fingers of the hand to handcuff grip 10 which prevents covering of the clasp lock opening with a portion of the hand. This provides safety to the officer by keeping visual attention on the suspect while reaching for and employing handcuff pair 100. Handcuff grip 10 also has a palm contour 35 generally spanning the length of handcuff grip 10 and disposed inwardly from a side edge 37 opposite finger contours 34 to further assist in orienting handcuff pair 100 in a proper attitude and to apply leverage from the arm of the officer to handcuff pair 100 after closing at least one of openable bar clasps 103. Applying leverage to the arm of the suspect is especially helpful when the suspect begins to resist or fails to comply with a lawful order. Thus, it can be readily observed that handcuff grip 10 generally covers the entire distance between wristlet lock portions 103 of handcuff pair 100 providing a comfortable surface for grasping handcuff pair 100 without encountering the difficulties in handling handcuff pair 100 presently presented to officers in the field.

In order to overcome the limitations of wet slippage and cold grasping, opposed bodies 11 and 12 of handcuff grip 10 have a textured surface 38 on at least one wristlet capturing member 18, 19 to enhance frictional contact of a human hand with grip 10. Preferably, textured surface 38 appears on all external surfaces 39 of wristlet capturing members 18, 19 and extends between ends 23 thereof. Textured surface 38 is preferably selected from the group comprising raised knobs, raised ridges separated by grooves, abrasive material, depressed dimples or a combination thereof, raised knobs 40 shown on surface 39 at the upper left of handcuff grip 10 with raised ridges 41 separated by grooves 42 shown on surface 39 at the upper right. Stippling shown on the lower left of surface 39 represents an abrasive material 43 while in a planar drawing, depressed dimples would effectively appear the same as raised knobs and thus are not separately shown.

Handcuff grip 10 may have wristlet lock capturing members 18, 19 are formed from material selected from the group comprising wood, metal, thermoplastic, rubber, ivory, or combinations thereof, but is preferably molded from a tough, yet resilient rubber compound. As handcuff grip 10 is preferably molded from rubber, it is possible to mold living hinge 27 between wristlet lock capturing members 18 which will have sufficient resiliency to stretch over the closed handcuff pair as shown in FIG. 2 thus comprising elastic hinge 21 and to mold living hinge 27 between wristlet lock capturing members 19 which will bend inwardly. Therefore, a combination of handcuff grip 10 and handcuff pair 100 is provided wherein handcuff grip 10 comprising a pair of opposed bodies 11, 12 is joined together over handcuff pair 100 and opposed bodies 11, 12 comprising wristlet lock capturing members 18 and 19 are joined by elastic living hinge 21. As opposed bodies 11, 12 are affixed to opposite sides of wristlet lock portions 103 of handcuff pair 100, elastic living hinge 21 is disposed between wristlet lock portions 103 of handcuff pair 100, elastic living hinge 21 located substantially over bendable joint 106 of link member 105 joining wristlet lock portions 103 together. Of course, it is fully understood that wristlet lock capturing members 18, 19 are thus identical and accordingly handcuff grip 10 may be folded along with handcuff pair 100 in an opposite direction where wristlet lock capturing members 18 are folded adjacent each other while wristlet lock capturing members 19 comprise the outermost pair of wristlet lock capturing members 18, 19. Therefore, hinge 20 is integrally formed between wristlet lock capturing members 18 and 19 of the same material as wristlet lock capturing members 18, 19, however it is also within the scope of this invention to produce one hinge 20 of one pair of wristlet lock capturing members 18 or 19 of the same material while forming hinge 20 on the other pair of wristlet lock capturing members 19 or 18 of a different material.

In the combination recited above, it should be apparent that elastic living hinge 21 facilitates opening of handcuff pair 100 by resuming an at rest position of elastic living hinge 21 when handcuff pair 100 and handcuff grip 10 are withdrawn from a carrying holster because elastic living hinge 21 of wristlet lock capturing members 18, 19 such as on an inner pair 19 as shown in FIG. 2 pushes inner pair 19 of wristlet lock capturing members 18, 19 apart and elastic living hinge 21 on an outer pair 18 of wristlet lock capturing members 18, 19 pulls outer pair 18 of wristlet lock capturing members 18, 19 into a straight line and when handcuff pair 100 is substantially in a straight line, wristlet lock capturing members 18, 19 are drawn together thus substantially completing a bridge between wristlet lock portions 103 of handcuffs 107.

Foldable manacles 110 having a different closing mechanism than common handcuffs 107 as shown in the figures are also the subject of this invention. Thus, foldable manacles 110, generally shown in the figures, having centrally disposed grip 10 foldable therewith comprise a pair of closeable wrist cuffs 111 similar to handcuffs 107, wrist cuffs 111 extending from one edge 112 of separate wristlet lock portions 103. Wristlet lock portions 103 are joined together by at least two links 105 of a link member 113, grip 10 comprising a pair of opposed bodies 11, 12 wherein opposed bodies 11, 12 each comprise a pair of wristlet lock capturing members 18 19. At least one of pair 118, 119 of wristlet lock capturing members 18, 19 is joined by an elastic living hinge 21 with opposed bodies 11, 12 affixed to wristlet lock portions 103 of foldable manacles 110. Elastic living hinge 21 is most preferably disposed between wristlet lock portions 103 of foldable manacles and substantially located over bendable joint 106 of link member 113 joining wristlet lock portions 103. As with handcuff pair 100, elastic living hinge 21 of grip 10 affixed to foldable manacles 110 facilitates opening of foldable manacles by resuming an at rest position of elastic living hinge 21 when withdrawn from a carrying holster wherein elastic living hinge 21 of an outer pair 118 of wristlet lock capturing members 103 pulls outer pair 118 of wristlet lock capturing members 103 together after full withdrawal from the carrying holster.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. A grip for a handcuff pair comprises a pair of opposed bodies, each of said opposed bodies comprising a pair of wristlet lock capturing members, at least one of said pair of wristlet lock capturing members joined together by a hinge, said opposed bodies having said wristlet lock capturing members capturing wristlet lock portions of said handcuff pair therebetween, said hinge disposed between said wristlet lock portions of said handcuff pair and substantially located over a bendable joint of a link member joining said wristlet lock portions together into said handcuff pair wherein said wristlet lock capturing members of one said opposed body are joined by a living hinge and said wristlet lock capturing members of the other said opposed body are joined by an elastic member.

2. A grip as in claim 1 wherein said wristlet lock capturing members are affixed to said wristlet lock portions of said handcuff pair.

3. A grip as in claim 1 wherein said wristlet lock capturing members have a lock capturing recess disposed into an inside surface thereof at the ends thereof.

4. A grip as in claim 3 wherein said wristlet lock capturing members are fastened into said lock capturing recess of said wristlet lock portions of said handcuff pair by means for fastening selected from the group comprising bolts, screws, adhesives, bayonet posts and sockets, rivets or push through fasteners.

5. A grip as in claim 3 wherein said wristlet lock capturing members of one said pair of opposed bodies are fastened to said wristlet lock capturing members of the other of said opposed bodies by means for fastening selected from the group comprising bolts, screws, adhesives, bayonet posts and sockets, rivets or push through fasteners, said wristlet lock capturing members capturing said wristlet locks therebetween wherein said link member retains said wristlet locks of said handcuff pair in said lock capturing recess disposed in said ends of said wristlet lock capturing members.

6. A grip as in claim 1 wherein said wristlet lock capturing members have a slot disposed through a portion thereof for accommodating said link member therein allowing for bending of said link member.

7. A grip as in claim 1 wherein said opposed bodies have a finger contours disposed inwardly from one side edge thereof to facilitate orientation of said handcuff pair in the proper attitude wherein an openable clasp bar of said handcuff pair is disposed adjacent said side edge carrying said finger contours.

8. A grip as in claim 1 wherein said opposed bodies have a palm contour disposed inwardly from a side edge opposite said finger contours to further assist in orienting said handcuff pair in the proper attitude.

9. A grip as in claim 1 wherein said opposed bodies have a textured surface on at least one of said wristlet capturing members to enhance frictional contact of a human hand with said grip.

10. A grip as in claim 9 wherein said textured surface is selected from the group comprising raised knobs, raised ridges separated by grooves, abrasive material, depressed dimples or a combination thereof.

11. A grip as in claim 1 wherein said wristlet lock capturing members are formed from material selected from the group comprising wood, metal, thermoplastic, rubber, ivory, or combinations thereof.

12. A grip as in claim 11 wherein said hinge is integrally formed between said at least one pair of wristlet lock capturing members of the same material as said wristlet lock capturing members.

13. In combination, a grip and a handcuff pair, said grip comprising a pair of opposed bodies, each of said opposed bodies comprising a pair of wristlet lock capturing members joined together by an elastic living hinge, said opposed bodies affixed to wristlet lock portions of said handcuff pair, said elastic living hinge disposed between said wristlet lock portions of said handcuff pair and substantially located over a bendable joint of a link member joining said wristlet lock portions together into said handcuff pair wherein said elastic living hinge facilitates opening of said handcuff pair by resuming an at rest position of said elastic living hinge wherein said elastic living hinge on an inner pair of said wristlet lock capturing members pushes said inner pair of said wristlet lock capturing members apart and said elastic living hinge on an outer pair of said wristlet lock capturing members pulls said outer pair of said wristlet lock capturing members together.

14. Foldable manacles having a centrally disposed trip foldable with said manacles, said manacles comprising a pair of closeable wrist cuffs, said wrist cuffs extending from one edge of separate wristlet lock portions, said wristlet lock portions joined together by at least two links of a link member, said grip comprising a pair of opposed bodies, said opposed bodies comprising a pair of wristlet lock capturing members, at least one of said pair of wristlet lock capturing members joined by an elastic living hinge, said opposed bodies affixed to said wristlet lock portions of said handcuff pair, said elastic living hine disposed between said wristlet lock portions of said handcuff pair and substantially located over one bendable joint of said link member joining said wristlet lock portions wherein said elastic living hinge facilitates opening of said handcuff pair by resuming an at rest position of said elastic living hinge wherein said elastic living hinge of an outer pair of said wristlet lock capturing members pulls said outer pair of said wristlet lock capturing members together.

* * * * *